United States Patent [19]

Kuehl et al.

[11] Patent Number: 4,864,962

[45] Date of Patent: Sep. 12, 1989

[54] COMBINATION FLAGPOLE AND BRACKET

[76] Inventors: Robert J. Kuehl, 331 Pease Rd.; Frank M. Falcone, 41 Edmund St., both of East Longmeadow, Mass. 01028

[21] Appl. No.: 244,309

[22] Filed: Sep. 15, 1988

[51] Int. Cl.[4] ..... G09F 17/00

[52] U.S. Cl. ..... 116/174; 40/617; 16/87.2; 116/173

[58] Field of Search ..... 116/173–174; 24/230.5 W, 546, 549; 248/291, 514, 538; 16/87.2; 40/602, 617

[56] References Cited

U.S. PATENT DOCUMENTS

| | | | |
|---|---|---|---|
| 817,477 | 4/1906 | Ferres | 16/87.2 |
| 869,256 | 10/1907 | McCormick | 16/87.2 |
| 1,525,515 | 2/1925 | Socha | 248/514 |
| 1,575,040 | 3/1926 | Crum | 116/173 |
| 1,597,266 | 8/1926 | Dearman | 248/514 |
| 2,799,240 | 7/1957 | Andrews | 116/174 |
| 3,183,886 | 5/1965 | Moffitt, Jr. | 116/173 |

FOREIGN PATENT DOCUMENTS

| | | | |
|---|---|---|---|
| 1515811 | 1/1968 | France | 16/87.2 |
| 257989 | 9/1926 | United Kingdom | 16/87.2 |

*Primary Examiner*—William A. Cuchlinski, Jr.
*Assistant Examiner*—W. Morris Worth
*Attorney, Agent, or Firm*—Ross, Ross & Flavin

[57] ABSTRACT

A flagpole for flags and pennants. Clips on the flag or pennant are rotatably received in circumferential grooves on the flagpole to prevent the flag or banner from becoming fouled or wrapped around the flagpole. An adjustable bracket is provided for holding the base of the flagpole relative to a supporting surface.

1 Claim, 2 Drawing Sheets

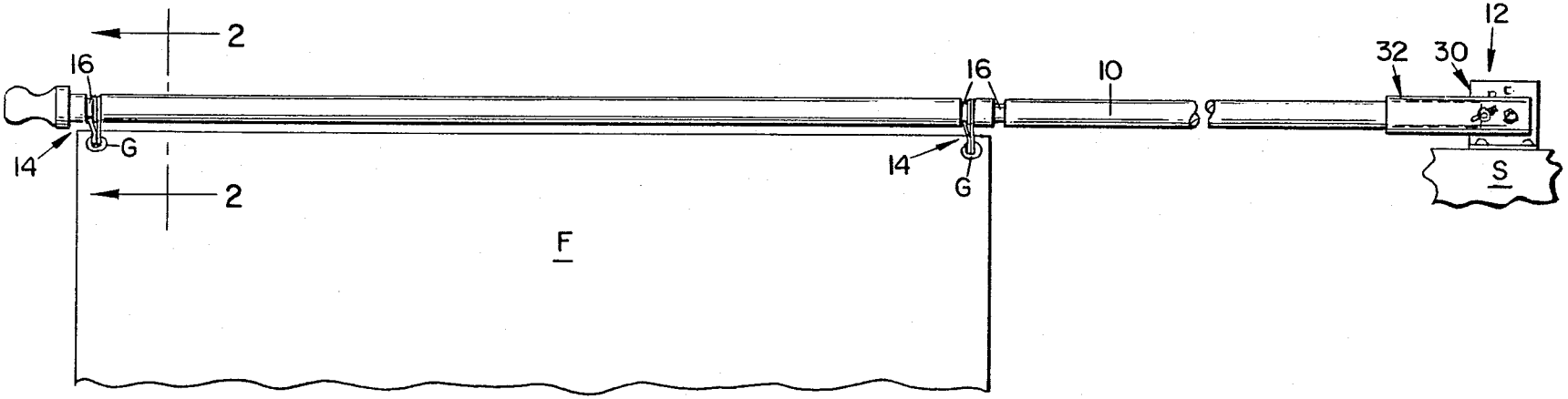
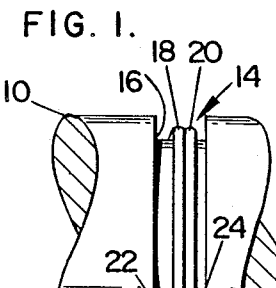
FIG. 1.
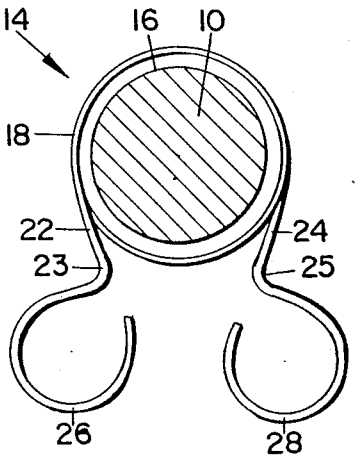
FIG. 3.
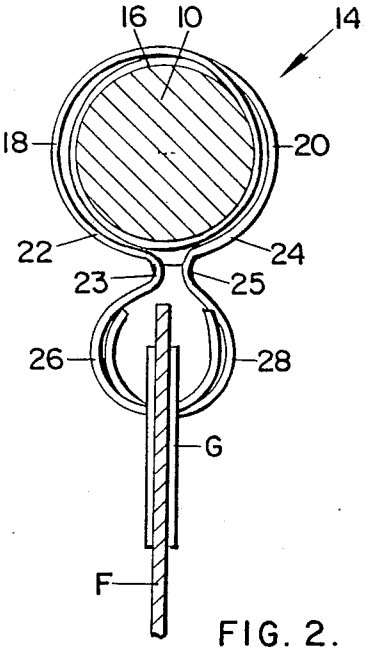
FIG. 2.
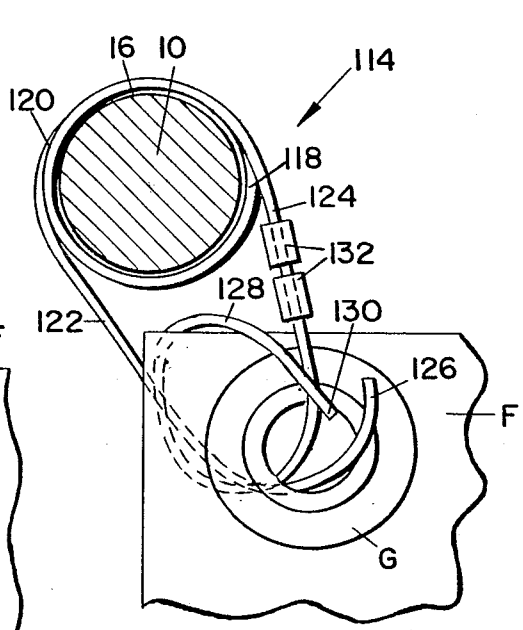
FIG. 5.
FIG. 4.

COMBINATION FLAGPOLE AND BRACKET

BACKGROUND OF THE INVENTION

1. Field of the Invention

The invention relates to a flagpole for flying flags and pennants and for precluding the flags or pennants from becoming fouled or wrapped around the pole and further relates to an adjustable bracket for holding the pole.

2. Description of the Prior Art

There is a wide variety of anti-fouling flagpoles and/or flagpole brackets. However, they are complicated in their structure, are unreliable in use, and are expensive in manufacture.

SUMMARY OF THE INVENTION

The invention hereof provides a simple, reliable, economical flagpole and bracket which precludes the fouling of the flag or pennant being flown, while permitting ready adjustment of the angle at which the flagpole is displayed relative to a supporting surface.

BRIEF DESCRIPTION OF THE DRAWINGS

FIG. 1 is a fragmentary front elevational view of a flagpole, an adjustable flagpole bracket, and a first form of spring clip of the invention engaged with the flagpole and a flag;

FIG. 2 is an enlarged cross-sectional view taken on line 2—2 of FIG. 1;

FIG. 3 is a cross-sectional view similar to FIG. 2 with the flag omitted and the spring clip shown in an expanded position;

FIG. 4 is an enlarged, fragmentary front elevational view of the spring clip of FIGS. 1–3 and a portion of the flagpole and flag of FIG. 1;

FIG. 5 is an enlarged part-sectional side elevational view similar to FIG. 2 showing a second form of spring clip of the invention and its manner of engagement with a flagpole and flag;

DESCRIPTION OF THE PREFERRED EMBODIMENTS

Figure 6:
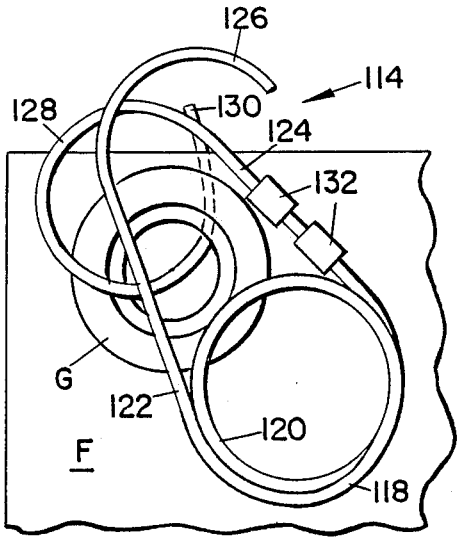
FIG. 6 is a view similar to FIG. 5 showing the manner of attachment of the spring clip of FIG. 5 to a flag.

With reference to FIG. 1, the invention includes a flagpole 10, an adjustable flagpole bracket 12 for receiving and holding the base of the flagpole relative to a supporting surface S, and a pair of spring clips 14 for hanging a flag F from the flagpole so that the flag will not become fouled relative to the flagpole.

Flagpole 10 is provided with a plurality of circumferential grooves 16 along its length for accepting and retaining spring clips 14 in manner to appear, the grooves being appropriately spaced along the pole so as to be aligned with the grommets G of flag F.

A sufficient number of grooves 16 is provided along the length of flagpole 10 so that it may accept flags of various sizes.

Spring clips 14 are formed from stainless steel or any corrosion resistant, resilient spring-type metal adapted for easy deformation and are coiled to form a helix having a pair of adjacent coils 18 and 20 each having a tail 22 and 24 respectively depending therefrom.

Tail 22 is deformed adjacent its lower end with a reverse bend as at 23 to form a depending, somewhat semi-circular appendage 26, while tail 24 is deformed adjacent its lower end with a reverse bend as at 25 to form a depending, somewhat semicircular appendage 28, the appendages 26 and 28 being mirror images of each other and being oppositely-facing relative to each other.

Coils 18 and 20 are of appropriate diameter as to be slidable along flagpole 10 and into one of the grooves 16 therein when appendages 26 and 28 are grasped by the fingers and spread to the expanded position of FIG. 3.

When the appendages 26 and 28 are released, coils 18 and 20 rest in groove 16. However, coils 18 and 20 have an inner diameter slightly larger than the outer diameter of the groove; thus, the coils are freely rotatable through a full 360 degree arc relative to the groove and flagpole.

Also, when the appendages 26 and 28 are moved to an expanded position, they may be easily inserted into the grommet G of flag F and, upon release, since they face in opposite directions, will firmly hold the flag against disengagement therefrom, even when the flag is whipped by a strong wind or is rotated relative to the flagpole.

FIGS. 5–8 illustrate a second form of clip 114 formed from stainless steel or any corrosion resistant, resilient spring-type metal adapted for easy deformation and engageable in the grooves 16 of flagpole 10.

Clip 114 is coiled to form a helix having a pair of adjacent coils 118 and 120 each having a tail 122 and 124 respectively depending substantially vertically therefrom.

Tail 122 is deformed adjacent its outer free end to form a curved, somewhat semi-circular appendage 126, while tail 124 is deformed adjacent its outer free end to form a somewhat circular appendage 128 having a free tab end 130 which overlaps tail 124.

Figure 7:
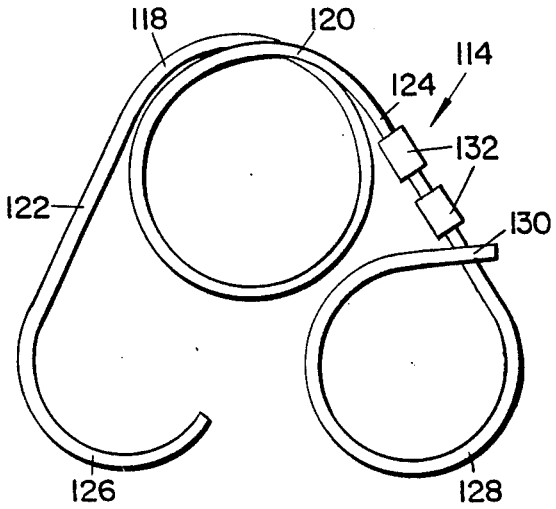
FIG. 7 is a view in front elevation showing the spring clip of FIG. 5 in an expanded position.
Figure 12:
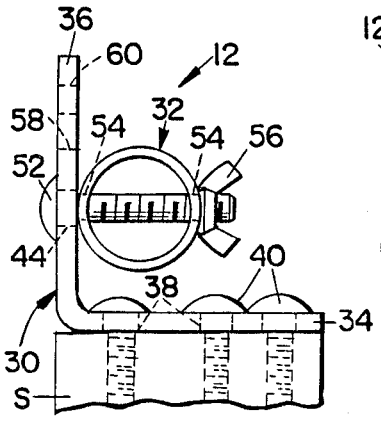
FIG. 12 is a side elevational view of the adjustable flagpole bracket of FIG. 10.
Figure 10:
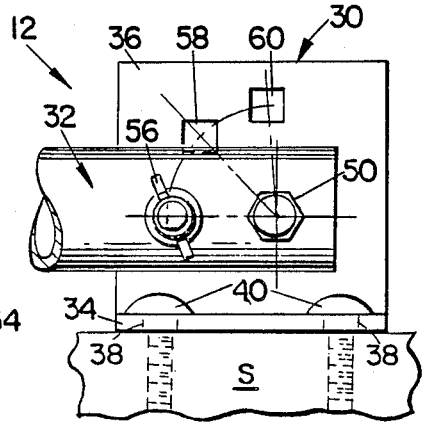
FIG. 10 is an enlarged, fragmentary front elevational view of the adjustable flagpole bracket of the invention.
Figure 11:
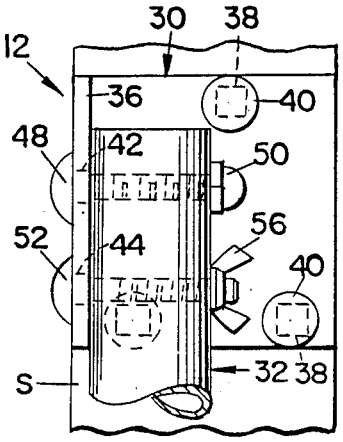
FIG. 11 is a view in top plan of the adjustable flagpole bracket of FIG. 10.

Coils 118 and 120 are of appropriate diameter as to be slidable along flagpole 10 and into one of the grooves 16 therein when appendages 126 and 128 are grasped by the fingers and spread to the expanded position of FIG. 7.

When the appendages 126 and 128 are released, coils 118 and 120 rest in groove 16. However, coils 118 and 120 have an inner diameter slightly larger than the outer diameter of the groove; thus, the coils are freely rotatable through a full 360 degree arc relative to the groove and flagpole.

Clip 114 may be attached to flag F by spreading the tab end 130 slightly away from tail 124 of appendage 128 and threading said tab end through grommet G to the position shown in FIG. 6 and then inserting the free end of appendage 126 through the grommet and moving the clip to the position shown in FIG. 5.

Such positioning of appendages 126 and 128 insures positive attachment of the flag to the clip while permitting full rotation of the clip relative to groove 16 of the flagpole to preclude fouling of the flag relative to the pole.

Figure 9:
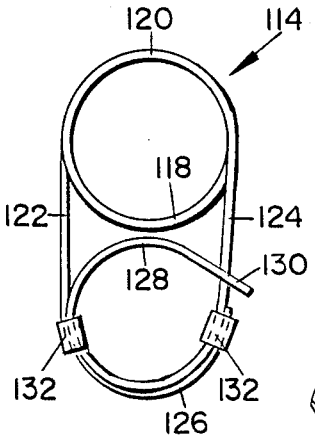
FIG. 9 is a view in front elevation of the spring clip of FIGS. 5–8 in a locked position.

Clear plastic tubular locks 132 are sleeved on tail 124 of appendage 128 and are slidable relative thereto to the position shown in FIG. 9 to lock appendages 126 and 128 together to prevent accidental dislodgement of clips 114 from engagement with grommets G of flag F.

Either the clips 14 of FIGS. 1–4 or the clips 114 of FIGS. 5–9 offer positive attachment of flag F to flagpole 10 while permitting full rotation of the flag relative to the flagpole without fouling.

With the clips 14, reverse bends 23 and 25 provide a positive locking feature of clip to flag.

With the clips 114, the locking feature is provided by tubular locks 132.

With reference to FIGS. 10–14, adjustable flagpole bracket 12 includes an L-shaped base 30 having a tubular flagpole support 32 releasably and adjustably secured thereto.

L-shaped base 30 has a horizontally disposed bottom wall 34 and an integral side wall 36 rising vertically upwardly therefrom along a side edge thereof, there being a plurality of openings 38 in bottom wall 34 through which bolts 40 or the like may be inserted to fasten base 30 to any supporting surface S.

Side wall 36 of base 30 has a first central opening 42 therethrough and a second opening 44 therethrough spaced from opening 42 and horizontally aligned therewith.

Figure 13:
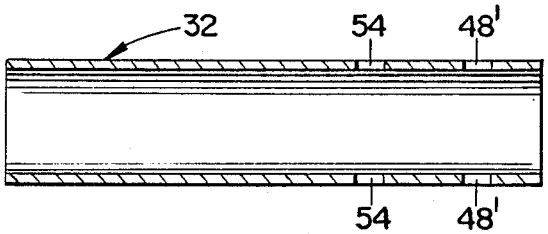
FIG. 13 is a longitudinal cross-sectional view taken through the flagpole support of the adjustable flagpole bracket of FIGS. 10–12.
Figure 8:
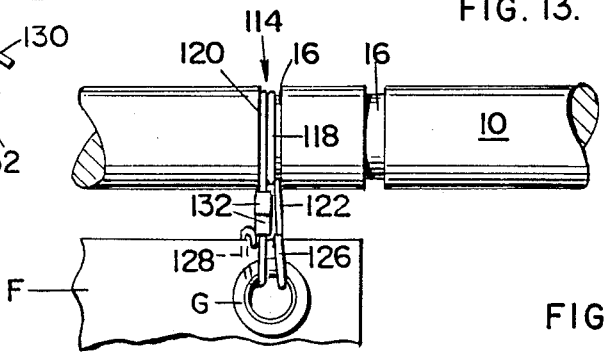
FIG. 8 is a fragmentary front elevational view of the spring clip of FIGS. 5–7 and its manner of engagement with the flagpole and flag of FIG. 1.
Figure 14:
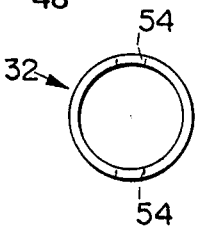
FIG. 14 is an end elevational view of the flagpole support of FIG. 13.

Tubular flagpole support 32 may be secured to base 30 by a first bolt 48 which extends through central opening 42 in side wall 36 and through a first pair of aligned openings 48' in the walls of flagpole support 32, best seen in FIG. 13, and has a cap nut 50 threaded thereon and bearing against a side of flagpole support 32.

A second bolt 52 extends through second opening 44 in side wall 36 of base 30 and through a second pair of aligned openings 54 in the walls of flagpole support 32 spaced from the first pair of openings 48'.

A wing nut 56 is threaded on the free end of second bolt 52 and bears against a side of flagpole support 32 whereby one end of the flagpole support is fixed to base 30 and the flagpole support extends substantially horizontally outwardly therefrom as shown in FIG. 1, with the free end of flagpole 10 being receivable therein so as to be sleeved by the flagpole support.

Third and fourth openings 58 and 60 respectively are provided in side wall 36 of base 30, with third opening 58 being disposed at an angle of approximately forthfive degrees relative to central opening 42 and with fourth opening 60 being disposed at an angle of approximately ninety degrees on an arc relative to central opening 42.

Thus, if it is desired to angularize flagpole support 32 and flagpole 10 relative to base 30, wing nut 56 is removed from second bolt 52 and the second bolt is removed from second opening 44 in wall 36 of base 30 and from second openings 54 of flagpole support 32 permitting the flagpole support to be rotated relative to base 30 upon first bolt 46 to an angularized position whereupon second bolt 52 is reinserted into either third opening 58 or fourth opening 60 in side wall 36 of base 30 and through second openings 54 of flagpole support 32 and wing nut 56 reengaged therewith to fix the flagpole support in an angularized position relative to base 30 and support S.

We claim:

1. In combination, a flagpole for displaying a flag or pennant, the flagpole having a base end, a bracket for receiving and holding the base end of the flagpole relative to a supporting surface, the bracket including a base fixed to the supporting surface, a flagpole support for receiving the base end of the flagpole, the flagpole support being adjustably and rotatably secured to the bracket base, the flagpole having a plurality of circumferential grooves therein along its length, clips for connecting the flag or pennant to the flagpole, the clips being formed from a deformable metal into a helix having a pair of first and second adjacent coils receivable in and freely rotatable relative to the grooves of the flagpole through a 360 degree arc, the coils each having a tail depending substantially vertically therefrom, each tail having an outer free end, the tail of the first coil being deformed adjacent its outer free end to form a curved somewhat semi-circular appendage, the tail of the second coil being deformed adjacent its outer free end to form a somewhat circular appendage having a free tab end which overlaps the tail of the second coil, tubular locks sleeved on the appendage of the tail of the second coil and slidable relative thereto to engage the appendage of the tail of the first coil to lock the appendages together, the appendages of the clips being receivable through provided openings in the flag or pennant.

* * * * *